US007960693B2

(12) United States Patent
Syms et al.

(10) Patent No.: US 7,960,693 B2
(45) Date of Patent: Jun. 14, 2011

(54) MICROENGINEERED ELECTRODE ASSEMBLY

(75) Inventors: Richard Syms, London (GB); Alan Finlay, Richmond (GB)

(73) Assignee: Microsaic Systems Limited, London (GB)

( * ) Notice: Subject to any disclaimer, the term of this patent is extended or adjusted under 35 U.S.C. 154(b) by 324 days.

(21) Appl. No.: 12/220,321

(22) Filed: Jul. 23, 2008

(65) Prior Publication Data

US 2009/0026361 A1 Jan. 29, 2009

(30) Foreign Application Priority Data

Jul. 23, 2007 (GB) ..... 0714316.7

(51) Int. Cl.
*H01J 49/42* (2006.01)

(52) U.S. Cl. ..... 250/292; 250/396 R

(58) Field of Classification Search ..... 250/292, 250/290, 396 R, 281, 282
See application file for complete search history.

(56) References Cited

U.S. PATENT DOCUMENTS

| | | | | |
|---|---|---|---|---|
| 3,129,327 | A | 4/1964 | Brubaker | |
| 3,371,204 | A | 2/1968 | Brubaker | |
| 3,471,691 | A | 10/1969 | Gielow et al. | |
| 4,866,279 | A * | 9/1989 | Schelten et al. | 250/396 R |
| 4,898,831 | A | 2/1990 | Smith | |
| 4,963,736 | A | 10/1990 | Douglas et al. | |
| 5,557,544 | A | 9/1996 | Simon et al. | |
| 6,025,591 | A | 2/2000 | Taylor et al. | |
| 6,157,031 | A | 12/2000 | Prestage | |
| 6,420,699 | B1 | 7/2002 | Herschbach et al. | |
| 6,465,792 | B1 | 10/2002 | Baptist | |
| 6,512,224 | B1 * | 1/2003 | Miller et al. | 250/286 |
| 6,642,514 | B2 | 11/2003 | Bateman et al. | |
| 6,977,371 | B2 | 12/2005 | Bateman et al. | |
| 7,208,729 | B2 | 4/2007 | Syms | |
| 7,495,212 | B2 * | 2/2009 | Kim et al. | 250/292 |
| 7,579,589 | B2 * | 8/2009 | Miller et al. | 250/292 |
| 2003/0109990 | A1 | 6/2003 | Axelsson | |
| 2005/0017166 | A1 | 1/2005 | Scheidemann et al. | |
| 2005/0199805 | A1 | 9/2005 | Freidhoff | |
| 2007/0026426 | A1 | 2/2007 | Fuernkranz et al. | |
| 2007/0029477 | A1 | 2/2007 | Miller et al. | |
| 2007/0096023 | A1 | 5/2007 | Freidhoff | |
| 2007/0158542 | A1 | 7/2007 | Bauer et al. | |
| 2008/0034219 | A1 | 2/2008 | Ting | |

FOREIGN PATENT DOCUMENTS

EP 0644576 A2 3/1995

(Continued)

OTHER PUBLICATIONS

Batey, J.H., "Quadrupole gas analysers," *Vacuum* 37, 659-668, 1987.

(Continued)

*Primary Examiner* — Kiet T Nguyen
(74) *Attorney, Agent, or Firm* — Bishop & Diehl, Ltd.

(57) ABSTRACT

Microengineered stacked ring electrode assemblies capable of acting as either RF or DC ion guides in an ion optical system, and method of fabricating same are described. The electrodes are fabricated using planar processing as sets of grooved, proud features formed in a layer of material lying on an insulating substrate. Two such structures are then stacked together to form a set of diaphragm electrodes with closed pupils. Arrangements for fabrication by patterning, etching and bonding are described, together with methods for tapering the electrode pupils or otherwise varying the ion path.

45 Claims, 5 Drawing Sheets

FOREIGN PATENT DOCUMENTS

| | | | |
|---|---|---|---|
| EP | 0793255 | A1 | 9/1997 |
| GB | 1082819 | | 9/1967 |
| GB | 2378755 | A | 2/2003 |
| GB | 23894908 | A | 6/2003 |
| GB | 2391694 | A | 2/2004 |
| GB | 2397690 | A | 7/2004 |
| GB | 2400231 | A | 10/2004 |
| GB | 2411046 | A | 6/2005 |
| GB | 0701809.6 | | 1/2007 |
| GB | 2428514 | A | 1/2007 |
| JP | 63037552 | A | 2/1988 |
| WO | WO 97/49111 | | 12/1997 |

OTHER PUBLICATIONS

Denison, D.R., "Operating Parameters of a Quadrupole in a Grounded Cylindrical Housing," *Journal of Vacuum Science and Technology*, vol. 8, No. 1, 266-269, 1971.

Brubaker, W.M., "Improved Quadrupole," Manuscript accepted for presentation at the Mass Spectroscopy Conference in Berlin, Sep. 25-29, 1967, and for publication in "Advance in Mass Spectrometry," vol. 4.

Syms, R.R.A., et al., "Fabrication of a microengineered quadrupole electrostatic lens," *Electronic Letters*, Oct. 24, 1996, vol. 32, No. 22.

Syms, R.R.A., et al., "Design of a Microengineered Electrostatic Quadrupole Lens," *IEEE Trans. on Electron Devices*, vol. 45, No. 11, 2304-2311, Nov. 1998.

Taylor, S. et al., "Performance improvements for a miniature quadrupole with a micromachined mass filter," *Vacuum*, 53, 203-206, 1999.

Geear M. et al., "Monolithic MEMS Quadrupole Mass Spectrometers by Deep Silicon Etching." *Journal of Microelectromechanical Systems*, vol. 14, No. 5, 1156-1166, Oct. 2005.

Sillon, N. et al., "Micromachined mass spectrometer," *Sensors and Actuators*, B 83, 129-137, 2002.+.

Douglas, D.J., "Applications of Collision Dynamics in Quadrupole Mass Spectrometry," *J. Am. Soc. Mass Spectrom.*, 9, pp. 101-113, 1988.

Gerlich, D., "Applications of RF Fields and Collision Dynamics in Atomic Mass Spectrometry," *J. Anal. At. Spect.*, 19, pp. 581-590, 2004.

Cha, B.C. et al., "An Interface With a Linear Quadrupole Ion Guide for an Electrospray-Ion Trap Spectrometer System," *Analytical Chemistry*, vol. 72, No. 22, pp. 5647-5654, Nov. 15, 2000.

Bahr, R. et al., "Eine Speicher-Ionquelle," *Verhandle. DPG*, vol. 4, p. 343, 1969.

Gerlich, D., "Inhomogeneous RF Fields: A Versatile Tool for the Study of Processes With Slow Ions," *State-Selected and State-to-State Ion-Molecule Reaction Dynamics, Part 1: Experiment*, Advances in Chemical Physics Series, vol. LXXXIL, 1992.

Guan, S. et al. "Stacked-Ring Electrostatic Ion Guide," *J. Am. Soc. Mass Spectrom.*, 7, pp. 101-106, 1996.

Takada, Y. et al., "Electrostatic Ion Guide Using Double Cylindrical Electrode for Atmospheric Pressure Ionization Mass Spectrometry," *Rev. Sci. Instrum*. 67, pp. 2139-2141, 1996.

Shaffer, Scott A. et al., "A Novel Ion Funnel for Focusing Ions at Elevated Pressure Using Electrospray Ionization Mass Spectrometry," *Rapid Communications in Mass Spectrometry*, vol. 11, pp. 1813-1817, 1997.

Giles, K. et al., "Applications of a Travelling Wave-Based Radio-Frequency-Only Stacked Ring Ion Guide," *Rapid Communications in Mass Spectrometry*, vol. 18, pp. 2401-2414, 2004.

Hynes, A.M. et al., "Recent Advances in Silicon Etching for MEMS Using the ASE™ Process," *Sensors and Actuators*, 74, pp. 13-17, 1999.

Lee, D.B., "Anisotropic Etching of Silicon," *Journal of Applied Physics*, vol. 40, No. 11, pp. 4569-4574, 1969.

Kersten, P. et al., "Photolithography on Micromachined 3D Surfaces Using Electrodeposited Photoresists," *Sensors and Actuators*, vol. 51, pp. 51-54, 1995.

Syms, R.R.A. et al., "A Microengineered Alignment Bench for a Nanospray Ionization Source," *J. Micromech. Microeng.*, vol. 17, pp. 1567-1574, 2007.

* cited by examiner

MICROENGINEERED ELECTRODE ASSEMBLY

CROSS-REFERENCE TO RELATED APPLICATIONS

This application claims priority to United Kingdom Application GB0714316.7, filed Jul. 23, 2007, which is hereby incorporated by reference.

FEDERALLY SPONSORED RESEARCH OR DEVELOPMENT

Not Applicable.

TECHNICAL FIELD

This invention relates to electrode assemblies and in particular to the provision of a miniature stacked ring electrode assemblies capable of acting as either RF or DC ion guides in the context of mass spectrometry.

BACKGROUND OF THE INVENTION

There is increasing interest in miniaturized ion optical systems for mass spectrometric analysis. For example, small quadrupole electrostatic lenses have been constructed by stacking together multilayer silicon substrates containing etched mounting features for cylindrical electrode rods and used as quadrupole mass spectrometers (Geear 2005; U.S. Pat. No. 7,208,729). Potential applications for such components include portable mass spectrometers for space exploration and the detection of pollutants, drugs, explosives and chemical and biochemical weapons.

Depending on the mode of operation of the system, other ion optical components may be required. For example, the ions may be generated at high or atmospheric pressure, and must be transported through a differentially pumped vacuum interface into a low pressure (or "high vacuum") chamber for analysis. In the process, the ions must be separated as far as possible from neutral species and concentrated to increase the intensity of the ion beam. Lens systems based on electrostatic fields that generate essentially ballistic ion trajectories are often inadequate for such purposes, due to the effect of collisions with background molecules.

However, time-varying fields at radio frequency (RF) frequencies may provide focusing at moderate pressure, due to the combined effect of an effectively static "pseudopotential" field derived from the time-varying potential distribution and the action of the ion-molecular collisions themselves. RF ion optical devices providing such pseudopotential fields are collectively known as ion guides and can be constructed using a variety of electrode arrangements. These electrode arrangements may in general be subdivided into types providing fields with and without an axial variation in potential (Douglas 1998; Gerlich 2004).

FIG. 1 shows the main principle of a stacked ring ion guide. A set of ring electrodes 101 is arranged at regular intervals along an axis, which serves as the axis of an ion beam 102. Alternate rings are connected together by bus bars 103*a* and 103*b* that are connected to a RF source 104, so that each alternate ring carries a voltage of opposite polarity. The motion of the ion beam in the resulting field may be divided into two components. The first is a fast-varying component due to the direct action of the alternating field, and the second is a slow-varying component due to an effective DC pseudopotential derived from the field. The second component acts to drive the ions towards the axis and provides the focusing exploited in beam concentrators and collision cells (Gerlich 2004).

An application of ion guides is in collision cells, in which previously selected ions are fragmented by application of energy in a region of locally higher pressure in tandem mass spectrometry (or MS-MS) systems. A further application is ion traps, in which ions are first stored and then released in a prescribed manner (Douglas 1998; Gerlich 2004).

One method of providing a suitable time-varying field is to use a RF-only quadrupole lens. Such an element provides a field with a strong transverse variation but no axial variation. This approach has been used inside a vacuum interface to assist in coupling between an atmospheric pressure ionization source and a high vacuum analysis chamber (Cha 2000; U.S. Pat. No. 4,963,736).

Another method of providing a suitable field is to use a set of stacked ring electrodes, with RF voltages applied between alternating electrodes (Bahr 1969; Gerlich 1992). Such an approach provides a field with both a transverse and an axial variation. Stacked ring ion guides have again been used to transport ions through differentially pumped chambers (U.S. Pat. No. 6,642,514), and in collision cells (GB 2,402,807A). Similar electrode arrangements have been used with direct current (DC) voltages (Shenheng 1996; Takada 1996), but these require high axial ion energy. Arrangements with gradually decreasing apertures have been used very successfully for ion concentration in the so-called 'ion funnel' (Shaffer 1997; WO 97/49111), and arrangements with travelling wave fields have been used to assist in ion transportation (Giles 2004; GB 2,400,231).

Generally, the stacked assembly is constructed from separate electrodes and insulators, with separate electrical connections. This approach becomes increasingly inconvenient as the size of the system is reduced. Methods of forming the electrodes from two interleaved machined blocks, each containing one of the two sets of electrodes, have also been described (GB 2,397,690). However, this approach requires three-dimensional machining operations to be carried out, which again becomes increasingly difficult as feature sizes reduce. Furthermore, these operations cannot easily be adapted to geometries involving curved or tapered ion paths.

Accordingly there is a need to provide a solution to the problems identified above. A further need arises in the provision of a ion guide that allows curved or tapered paths.

SUMMARY OF THE INVENTION

These needs and other are addressed by a microengineered ion guide formed in accordance with the teaching of the present invention. Such a guide may be fabricated as a miniature stacked ring electrode assembly that is monolithic or involves a small numbers of parts. By fabricating such a guide using known planar processes and whose operation is essentially independent of the layout of the electrodes, the techniques provided in accordance with the teaching of the invention may be carried out on wafers to yield devices in small batches. It is possible following the teaching of the invention to provide curved or tapered ion paths in miniature stacked ring ion guides.

Microengineered ion guides provided in accordance with the teaching of the invention are formed from miniature stacked ring electrode assemblies capable of acting as either RF or DC ion guides in an ion optical system. The electrodes may be fabricated in two halves, on two separate substrates. Alternatively a first substrate may be processed to define the necessary features required for formation of the ion guide, then separated into two or more portions which are sandwiched together to form the final structure. In each arrangement, each substrate carries a set of features which cooperate when sandwiched, with corresponding features on the second mating substrate to form a closed pupil. Desirably such a pupil is fabricated by forming on an upper surface of each of the features a groove. When two opposing grooves are brought together they form a contiguous surface defining an aperture within the features which forms the requisite closed pupils. The features on the first and second substrates desirably form a set of diaphragm electrodes. Such ion guides may be fabricated by etching and wafer bonding and the invention also teaches methods for varying the size of the electrode pupils along the ion path and for varying the direction of the ion path.

The construction of the microengineered stacked ring ion guide fabricated in accordance with the teaching of the invention may be better understood with reference to FIGS. 2-7, which are, it will be appreciated, provided to assist in an understanding of the teaching of the invention and are not to be construed as limiting in any fashion.

DETAILED DESCRIPTION

Figure 1:
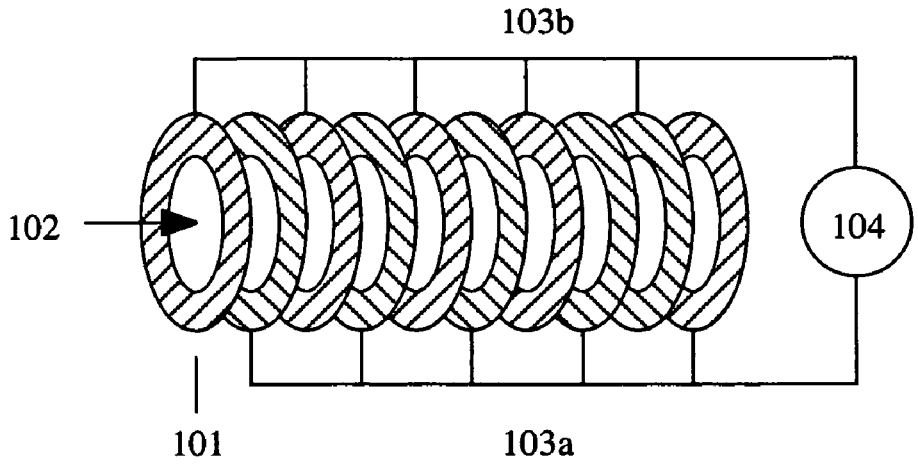
Figure 1. PRIOR ART
FIG. 1 shows a stacked ring RF ion guide, according to the prior art.

An example of a conventional ion guide has been described with reference to FIG. 1. The inventors of the present invention have realized that below a certain size scale, typically a few hundred microns in feature size, conventional machining methods such as milling, slotting and drilling become inappropriate for fabricating complex structures. Instead, microengineering or microfabrication methods are employed. These processes are known elsewhere as techniques that are generally carried out on planar substrates, which are often silicon or multilayers containing silicon or other semiconducting materials. Within the context of the following description techniques including patterning methods such as photolithography, etching methods such as wet chemical etching, crystal plane etching, plasma etching, deep reactive ion etching and powder blasting, coating methods such as evaporation and sputtering, and wafer bonding methods such as thermocompression bonding, anodic bonding and soldering will be useful. These methods are well known to those skilled in the art and require no explanation here.

Figure 2:
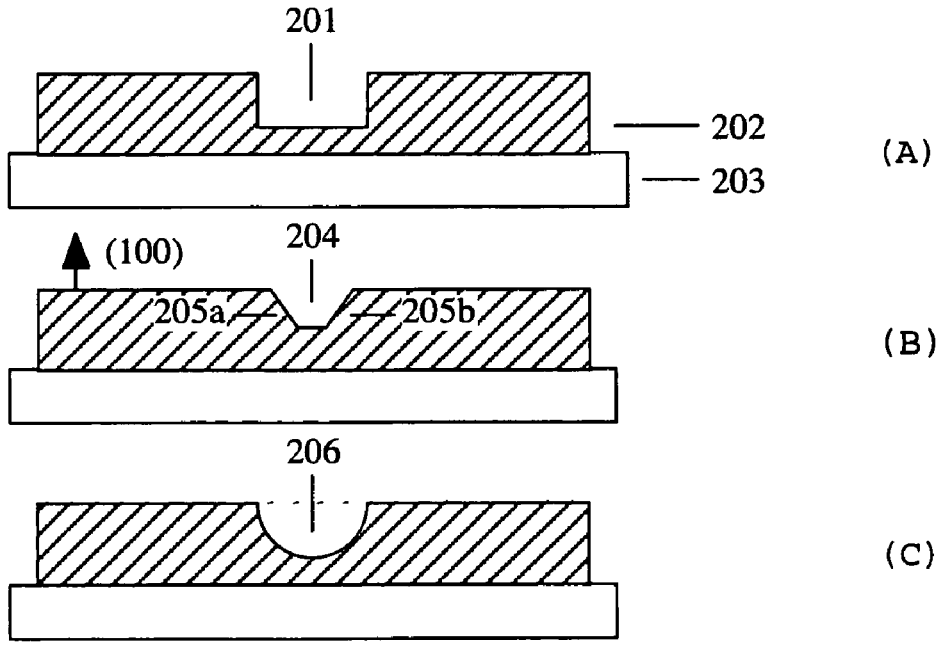
FIG. 2 shows in cross-section different groove shapes (rectangular, truncated triangular and semicircular) fabricated in a layer of material on a substrate, which may be useful according to the present invention.

It will be understood that patterning and etching methods act on an exposed surface and as such it is difficult to form closed pupils in a set of diaphragm electrodes lying perpendicular to the surface. The present inventors have realized that these difficulties can be overcome if the structure is fabricated in two halves, which are then assembled by stacking or bringing together to form a sandwich structure, with the electrodes provided in an inner portion of the sandwich. It is then possible to use planar processing to form groove shaped features on each half, as shown in FIG. 2, which are subsequently combined together to form complete apertures.

For example, following the teaching of the invention, it is possible to form a rectangular groove 201 in a layer 202 lying on a substrate 203. If (for example) the material of the layer is silicon, a suitable groove may be formed through deep reactive ion etching, using a surface mask with a strip-shaped opening. Deep reactive ion etching is a method of structuring silicon that uses alternating cycles of etching and passivation in a high density inductively coupled plasma to provide highly anisotropic etching (Hynes 1999).

Similarly, a groove 204 bounded by sloping walls may be formed by wet chemical etching down (111) crystal planes in (100) oriented silicon (Lee 1969). If such a groove is etched to completion, its cross-section will be triangular. However, if it is not etched to completion (as shown here), it will be truncated, with a (100) plane lying at its base.

Similarly, an approximately semicircular groove 205 may be formed by an isotropic plasma etch, which may be provided by omitting the passivation cycles in a deep reactive ion etching process. Similar grooves may be formed using abrasive powder blasting. More restrictively, straight grooves may be formed using a dicing saw with a profiled blade. The layer 202 is upstanding from the surface 203 of the substrate and the groove is formed in an upper surface of the layer 202. The layer may be considered a feature that is standing proud of the substrate and having a depression or recess, the groove, formed in an upper surface thereof.

If the required electrode pupil is too large, groove depths greater than the thickness of the single layer derived from (for example) a standard silicon wafer may be required. In this case, the groove may be formed in a multilayer, which may itself be formed by stacking and bonding more than one layer of material.

Figure 3:
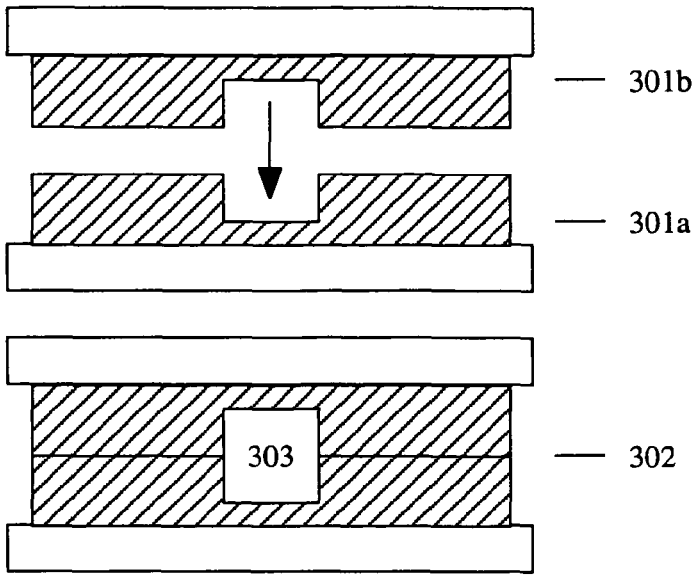
FIG. 3 shows in cross-section a formation of a diaphragm electrode with a closed pupil from two substrates carrying grooved proud features, according to the present invention.

Once patterned, two such grooved structures 301*a* and 301*b* may be combined together with their etched surfaces aligned and abutted to form a structure 302 as shown in FIG. 3. It will be appreciated that this arrangement will create a substantially closed channel 303 lying in the plane of the substrates. The channel 303 is formed from the mating of the first 301*a* and second 301*b* substrates in a manner that provides for an overlap of the previously etched groove feature in each of the substrates. While the groove feature represents a depression in the upper surface of the feature, it has a surface which when two features are brought together in a sandwich structure—such as described in FIG. 3—the surfaces of the opposing grooves form a contiguous surface defining the closed pupil or channel 303. The pupil may be considered as being formed in a ridge structure upstanding from the surface of the substrate, the ridge structure forming a diaphragm electrode.

Figure 4:
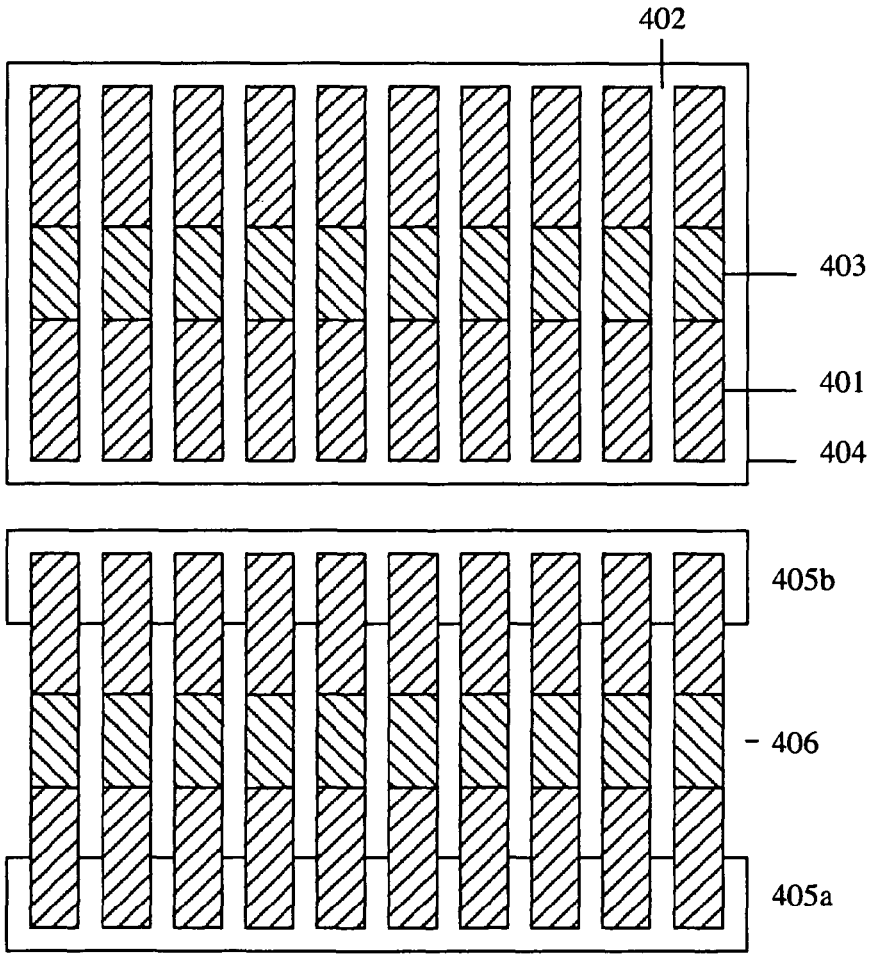
FIG. 4 shows in plan a layout of a single substrate of a stacked ring ion guide with separated electrodes, according to the present invention.

Additional patterning and directional etching processes such as deep reactive ion etching may be used to define a set of separate electrode features 401 separated by small gaps 402 and containing grooves 403, lying on a common substrate 404 as shown in FIG. 4. The substrate may be partially removed to leave two distinct sections 405*a* and 405*b* separated by a gap 406. It will be appreciated that the underlying substrate can provide electrical isolation between the electrodes if formed in a suitable insulating material, for example, a glass, a plastic or ceramic. It will also be appreciated that the gap 406 may serve to minimize charging effects in an application involving an ion beam.

If the second patterning and etching steps are carried out after formation of the initial groove, the second lithography must be carried out on a surface that is substantially non-planar. The necessary photoresist layer may be formed using an electrically deposited photoresist (Kersten 1995). Such a process has been described and used to construct an electrode system in an alternative ion optical application involving electrospray (Syms 2007; GB 0514843.2).

It will be appreciated that the combination of two such substrates as will create a structure containing a set of diaphragms containing closed pupils, and hence will form the main features of a stacked ring ion guide shown previously in FIG. 1. The use of the word "stack" in this context will be understood as a plurality of electrodes each provided with a closed pupil arranged along an ion path axis. The axis is longitudinal such that the stack may be considered as being a stack arranged in an orientation substantially transverse to the upper surfaces of the substrates. Each of the formed electrodes form one of the rings of the stacked ring ion guide.

It will also be appreciated that the cross-sections in FIG. 2 will give rise to different approximations to the most desirable electrode pupil shape, namely a circle. It will further be appreciated that this mode of construction differs from that of GB 2,397,690, in which the structure is fabricated in two halves, each half containing complete ring electrodes rather than partial rings as shown here. It will be understood that by following the teaching heretofore it is possible to ensure that the ion axis through the ring arrangement is substantially coincident with the central axis of the pupil. As the pupil is fabricated from two equal half portions, this means that the ion axis is substantially located along the plane defined by the mating surfaces of the two features 202. By etching one feature more dominantly than the other such that the final aperture is predominately located in one half of the sandwich structure, it will be understood that a shift in the ion axis towards that side of the structure will be effected. If, in the ultimate etching arrangement that a groove is only fabricated in one half of the sandwich structure and that the second half simply seals the aperture, then the ion axis will be wholly defined within the feature that defines the groove.

Assembly of the complete structure may be carried out by a variety of methods, including but not restricted to gluing, soldering, and bonding. Some of these methods (for example, soldering) require the deposition of an additional metal layer on the exposed upper surface of each etched layer. Suitable metals include (but are not restricted to) copper and gold, and suitable methods of deposition include RF sputtering. Such a layer can also serve to improve electrical conductivity, and provide a means for electrical contact to the electrodes, and for attaching bond wires. The metal layer may coat the sidewalls of the electrodes. In this case, a method must be provided to ensure that a short circuit between electrodes is not created via the substrate. One suitable method is to form the electrodes on a first wafer, which is subsequently attached to the second insulating substrate wafer.

Figure 5:
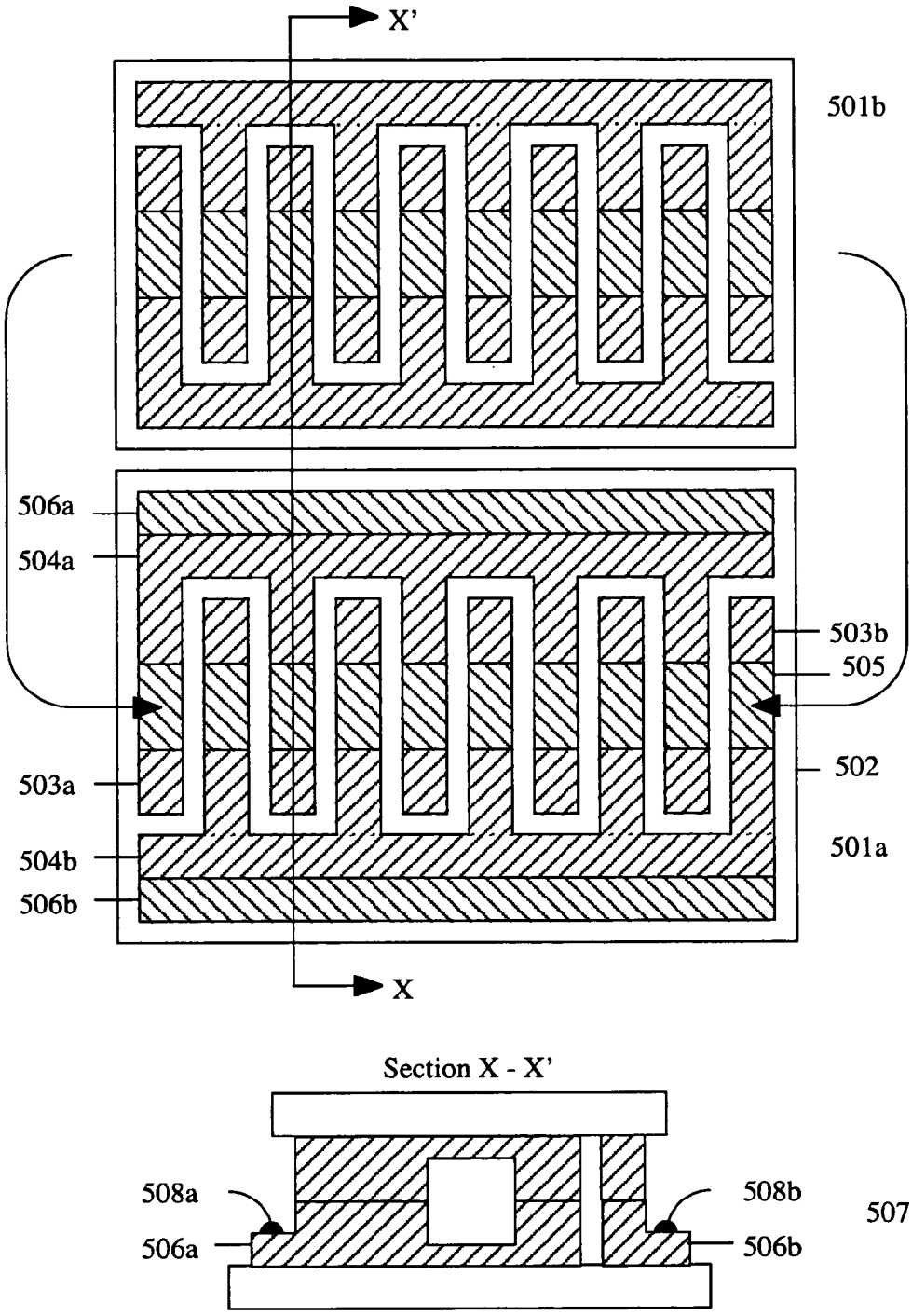
FIG. 5 shows in plan and cross-section a suitable layout and assembly of a complete stacked ring ion guide with bus bars interconnecting the electrodes, according to the present invention.

Similar secondary patterning and etching processes may be used to define a structure 501*a* consisting of a substrate 502 carrying two sets of electrodes 503*a* and 503*b* linked together with bus bars 504*a* and 504*b* as shown in FIG. 5. The electrodes 503*a* and 503*b* may carry a common etched groove 505 and the bus bars 504*a* and 504*b* may carry etched recesses 506*a* and 506*b*. A similar, but slightly smaller structure 501*b* may be constructed in a similar way, carrying a mirror image of the electrode layout but omitting the recessed sections of the bus bars.

It will be appreciated that the structures 501*a* and 501*b* may be combined together to form an assembly 507. If the upper surface of each electrode structure is metallized, it will be appreciated that bond wires 508*a* and 508*b* may be attached to the exposed recesses 506*a* and 506*b* to provide electrical connections. The electrical connections may be used to apply voltages to the electrodes following the scheme shown in FIG. 1.

Figure 6:
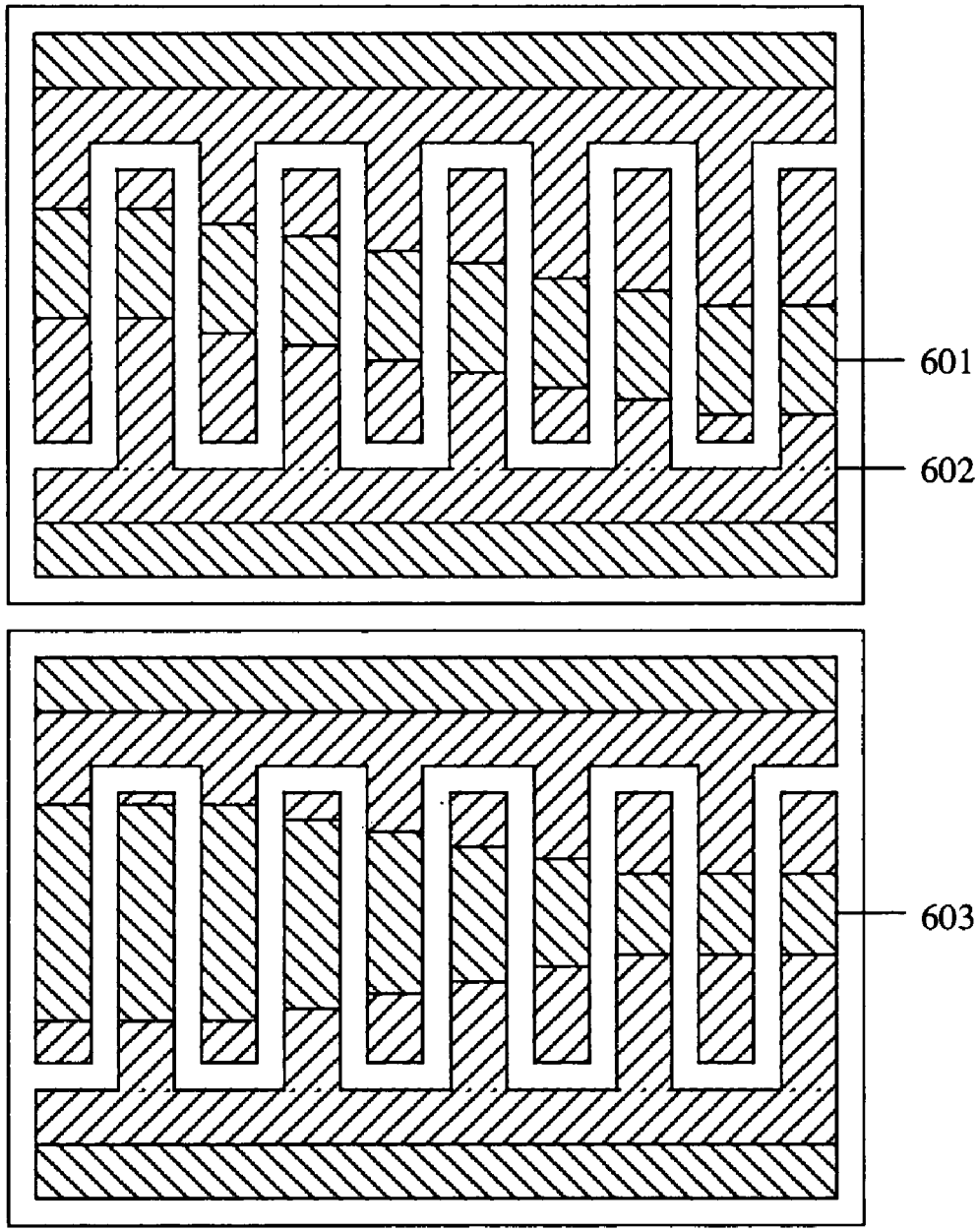
FIG. 6 shows in plan layouts of meandered and tapered ion guides, provided according to the present invention.

It will further be appreciated that there are considerable possibilities for realizing different arrangements of ion guide, depending on the initial lithographic pattern and the process used for forming the groove. FIG. 6 shows two examples. The axis of ion propagation may be meandered, by slowly varying the lithographic pattern used to define the position of the groove 601. Larger variations of the direction of the ion path may also be created, by additionally varying the lithographic pattern used to define the position and orientation of the separate electrodes 602. For example, a circular ion path may be provided, by bending the groove into a complete circle, and arranging the electrodes as radial spokes. In this case, an ion storage ring may be constructed.

The effective width of the ion guide may also be varied, by slowly varying the lithographic pattern used to define the width of the groove 603. The groove may also be varied in depth using suitable etching process, such as multi-step etching with a movable mask that serves to protect different parts of the structure for parts of the process, so that they are etched for different times. In this case, an ion funnel may be constructed.

The fabrication methods described above may be applied to a complete wafer, which will conventionally be large enough to contain a number of similar components. The wafer may therefore provide sufficient components for a batch of separate ion guides. However, it will be appreciated that several such ion guides may be arranged in parallel on larger dies, to provide components capable of guiding several ion streams in parallel.

The fabrication methods above are in some cases compatible with the formation of an additional ion optical component, for example a quadrupole mass filter as described in GB 0701809.6, the content of which is incorporated herein by reference. This application describes a quadrupole acting in conjunction with a prefilter and is formed using a compatible two substrate assembly. In this way it will be understood that the fabrication of the mass filter may be made concurrently with the ion optics such that the ions within the ion guide provided by the present invention may be directly interfaced into the mass filter. Furthermore it will be appreciated that the ion axis of the mass filter and the ion may be co-linear. It will therefore be appreciated that this invention may be used in conjunction with such a mass filter, acting to transport ions to the mass filter for analysis, and could be fabricated on the same base substrate such that an integrated devices is formed. An ion guide provided in accordance with the teaching of the invention could of course be used in conjunction with other types of mass filters including those not based on quadrupole configurations.

Figure 7:
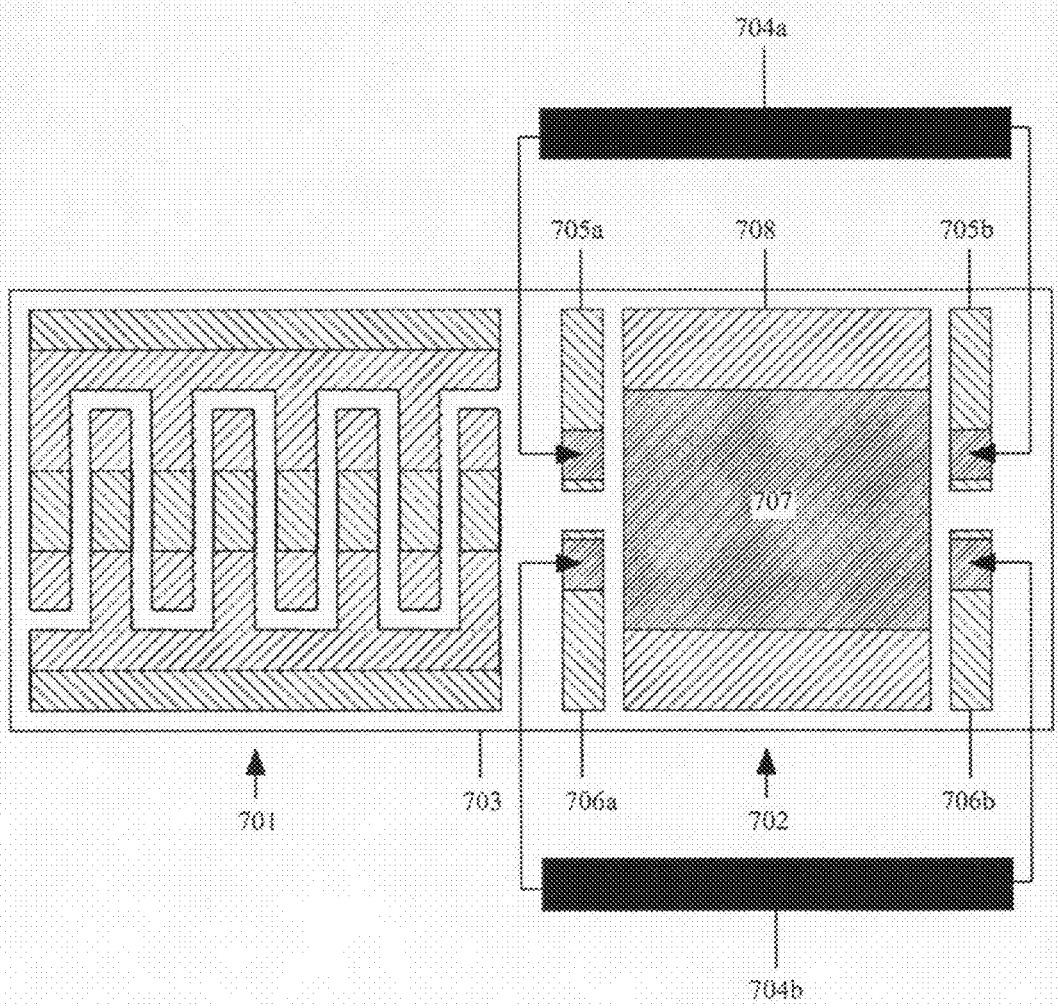
FIG. 7 shows a microengineered ion guide located on a common substrate with a microengineered electrostatic quadrupole mass filter, according to the teaching of the present invention.

FIG. 7 shows however an example of a microengineered ion guide 701 and a microengineered electrostatic quadrupole mass filter 702 located on a common substrate 703, according to the teaching of the invention. The quadrupole lens which is used in the formation of the mass filter is also fabricated in two halves that are assembled by stacking. Each half of the quadrupole lens is constructed by inserting two cylindrical conducting electrode rods 704*a* and 704*b* into pairs of etched, metallized features 705*a*, 705*b* and 706*a*, 706*b* that provide mechanical mounts for and electrical connections to the rods. The electrode rods straddle an etched, metallized trench 707 formed in a raised feature 708. A detailed description of such an arrangement is provided in GB 0701809.6, the content of which is incorporated herein by way of reference.

When the structure is assembled, the pairs of rods on each substrate combine to form a quadrupole electrode arrangement, while the raised features 708 in the two halves of the structure combine to provide both a mechanical spacer between the substrates and a surrounding shield for the quadrupole.

By extension of the same teachings, a short RF-only quadrupole, which is not shown here, may be interposed between the ion guide and the quadrupole mass filter to act as a quadrupole ion guide pre-filter. Similarly, a short RF-only quadrupole, which is again not shown, may be provided after the quadrupole mass filter to act as a quadrupole ion guide post-filter. Alternatively, a further stacked ring ion guide may be provided after the quadrupole mass filter to transport ions elsewhere for further processing.

From these examples, it will be apparent to the person skilled in the art that following the teaching of the invention that many useful combinations of stacked ring ion guide, quadrupole ion guide and quadrupole filter may be formed. In each case, one advantage of the stacked construction is the ease with which apparently dissimilar components may be combined. A further advantage is the ease with which the ion axis may be located at a common distance from each substrate, enabling low-loss ion transmission between components. By forming such devices from first and second substrates that are then mated to one another to form the final sandwich structure, it is possible to provide highly integrated arrangements using common fabrication techniques.

It will also be apparent to the person skilled in the art that following the teaching of the invention that there will be occasions when a common substrate format is advantageous, for example in a low cost disposable arrangement. Conversely, there will also be occasions when it will be desirable to form the components on separate substrates, for example to allow a contaminated quadrupole mass filter to be removed and replaced without disturbing the ion guide. In this way it will be understood that the teaching of the invention is not to be construed in any way limiting except as may be deemed necessary in the light of the appended claims.

When placed in a region of intermediate pressure located at the output of a first mass filter, an ion guide provided in accordance with the teaching of the invention may additionally provide an ion fragmentation function, acting to transport fragments of ions selected by the first mass filter to a second mass filter for analysis.

It will be further appreciated that some applications may require the use of DC voltages in addition to AC voltages, or the use of DC voltages instead of AC voltages in a DC ion guide. These voltages may be provided without modification to the structure described thus far. It will also be appreciated that some applications may require completely a different voltage to be applied to each electrode. These voltages may be provided by omitting the bus bars interconnecting the electrode sets as shown in FIG. 4, and forming separate wire bond connections to each electrode.

An ion guide provided in accordance with the teaching of the invention may be provided with a unique identifier to assist in a subsequent tracking of the ion guide for one of a number of different purposes. Such provision of a unique identifier may be in the form of a storeable numeric or alphanumeric indicia that is uniquely associatable with the ion guide and that may be subsequently used in establishing usage of that ion guide. The indicia may be stored in an EPROM or other memory storage device that is externally accessible by a third party or device. It will be understood that the decision on the optimum type of identifier chosen will be dependent on the operating conditions of the ion guide, in that the reading of the identifier should not prejudice the operation of the ion guide. An example of how personalization may be achieved in a mass analysis environment is described in our co-pending U.S. application Ser. No. 11/711,142, the content of which is incorporated herein by reference. Techniques used in this disclosure may be equally applicable within the context of personalization of devices provided in accordance with the teaching of the present invention.

It will be understood that what has been described herein is an exemplary method of fabricating a micro-engineered ion guide. By forming the features of the ion guide in two separate substrates and then bringing the substrates together in a sandwich structure it is possible to fabricate a number of adjacent electrodes, each having an aperture defined thereon. Alignment of the apertures and application of appropriate voltages to adjacent electrodes effects the formation of an ion guide. What has also been described is a combined ion guide mass spectrometer arrangement which may be fabricated on a common substrate. While the teaching of the invention has been described with reference to exemplary embodiments thereof it will be understood that such exemplary embodiments while being useful in an understanding of the teaching of the invention are not intended to limit the invention in any way except as may be deemed necessary in the light of the appended claims. Features described with reference to one or more of the accompanying figures could be used with or interchanged with those of others of the Figures without departing from the scope of the invention.

There are therefore many processes that achieve a similar objective.

Within the context of the present invention the term microengineered or microengineering or microfabricated or microfabrication is intended to define the fabrication of three dimensional structures and devices with dimensions in the order of microns. It combines the technologies of microelectronics and micromachining. Microelectronics allows the fabrication of integrated circuits from silicon wafers whereas micromachining is the production of three-dimensional structures, primarily from silicon wafers. This may be achieved by removal of material from the wafer or addition of material on or in the wafer. The attractions of microengineering may be summarized as batch fabrication of devices leading to reduced production costs, miniaturization resulting in materials savings, miniaturization resulting in faster response times and reduced device invasiveness. Wide varieties of techniques exist for the microengineering of wafers, and will be well known to the person skilled in the art. The techniques may be divided into those related to the removal of material and those pertaining to the deposition or addition of material to the wafer.

Examples of the former include:

Wet chemical etching (anisotropic and isotropic)
Electrochemical or photo assisted electrochemical etching
Dry plasma or reactive ion etching
Ion beam milling
Laser machining
Eximer laser machining Whereas examples of the latter include:

Evaporation
Thick film deposition
Sputtering
Electroplating
Electroforming
Moulding
Chemical vapour deposition (CVD)
Epitaxy These techniques can be combined with wafer bonding to produce complex three-dimensional, examples of which are the ion guides devices provided by the present invention.

Where the words "upper", "lower", "top", bottom, "interior", "exterior" and the like have been used, it will be understood that these are used to convey the mutual arrangement of the substrates and their supported features relative to one another and are not to be interpreted as limiting the invention to such a configuration where for example a surface designated a top surface is not above a surface designated a lower surface.

Furthermore, the words comprises/comprising when used in this specification are to specify the presence of stated features, integers, steps or components but does not preclude the presence or addition of one or more other features, integers, steps, components or groups thereof.

REFERENCES

Geear M., Syms R. R. A., Wright S., Holmes A. S. "Monolithic MEMS quadrupole mass spectrometers by deep silicon etching" IEEE/ASME J. Microelectromech. Syst. 14 1156-1166 (2005)

Syms R. R. A. "Monolithic microengineered mass spectrometer" U.S. Pat. No. 7,208,729 Apr. 24 (2007)

Syms R. R. A. "High performance microfabricated electrostatic quadrupole lens" GB Patent application 0701809.6 Jan. 31 (2007)

Douglas D. J. "Applications of collision dynamics in quadrupole mass spectrometry" J. Am. Soc. Mass Spect. 9, 101-113 (1998)

Gerlich D. "Application of RF fields and collision dynamics in atomic mass spectrometry" J. Anal. At. Spect. 19, 581-590 (2004)

Cha B. C., Blades M., Douglas D. J. "An interface with a linear quadrupole ion guide for an electrospray-ion trap mass spectrometer system" Anal. Chem. 72, 5647-5654 (2000)

Douglas D. J., French J. B. "Mass spectrometer and method and improved ion transmission" U.S. Pat. No. 4,963,736 Oct. 16 (1990)

Bahr R., Teloy E., Werner R. "Eine speicher-ionquelle" Verhandl. DPG (VI) 4, 343 (1969)

Gerlich D. "Inhomogeneous RF fields: a versatile tool for the study of processes with slow ions" in State-Selected and State-to-state Ion-molecule Reaction Dynamics. Part 1: Experiment, Edited by Ng C. Y., and Baer M., Adv. Chem. Phys. Ser, Vol LXXXII, John Wiley and Sons (1992)

Bateman R. H., Giles K. "Mass spectrometers and methods of mass spectrometry" U.S. Pat. No. 6,642,514 B2 Nov. 4. (2003)

Bateman R. H., Giles K. "Mass spectrometer" U.S. Pat. No. 6,977,371 B2 Dec. 20 (2005)

Shenheng G., Marshall A. G. "Stacked-ring electrostatic ion guide" J. Am. Soc. Mass Spect. 7, 101-106 (1996)

Takada Y., Sakairi M., Ose Y. "Electrostatic ion guide using double cylindrical electrode for atmospheric pressure ionization mass spectrometry" Rev. Sci. Inst. 67, 2139-2141 (1996)

Shaffer S. A., Tang K. Q., Anderson G. A., Prior D. C., Udseth H. R., Smith R. D. "A novel ion funnel for focusing ions at elevated pressure using electrospray ionization mass spectrometry" Rapid Comm. in Mass Spect. 11, 1813-1817 (1997)

Smith R., Tang K., Anderson G. A. "Method and apparatus for ion and charged particle focusing" WO 97/49111 Dec. 24 (1997)

Giles K., Pringle S. D., Worthington K. R., Little D., Wildgoose J. L., Bateman R. H. "Applications of a travelling wave-based radio-frequency-only stacked ring ion guide" Rapid Comm. in Mass Spect. 18, 2401-2414 (2004)

Bateman R. H., Giles K., Pringle S. "An ion guide supplied with a DC potential which travels along its length" GB 2,400,231 A Oct. 6 (2004)

Bateman R. H., Giles K. "AC tunnel ion guide for a mass spectrometer" GB 2,397,690 A Jul. 28 (2004)

Hynes A. M., Ashraf H., Bhardwaj J. K., Hopkins J., Johnston I., Shepherd J. N. "Recent advances in silicon etching for MEMS using the ASE™ process" Sensors and Actuators 74, 13-17 (1999)

Lee D. B. "Anisotropic etching of silicon" J. Appl. Phys. 40, 4569-4574 (1969)

Kersten P., Bouwstra S., Petersen J. W. "Photolithography on micromachined 3D surfaces using electrodeposited photoresists" Sensors and Actuators A 51, 51-54 (1995)

Syms R. R. A. "Microengineered nanospray electrode system" GB Patent GBB2428514

Syms R. R. A., Zou H., Bardwell M., Schwab M.-A. "Microengineered alignment bench for a nanospray ionisation source" J. Micromech. Microeng. 17, 1567-1574 (2007)

What is claimed is:

1. A microengineered stacked ring RF-only ion guide defining an ion path, the guide comprising first and second substrates, each of the first and second substrates having at least first and second features defined thereon, the features being configured such that when the first and second substrates are brought together the features on opposing substrates combine to form complete diaphragm electrodes containing closed pupils; each of the closed pupils in adjacent diaphragm electrodes cooperating to form an ion path through the ion guide with a central axis of the pupils defining the ion path, and wherein neighboring electrodes are coupled to a voltage supply of an opposing polarity to that of their neighbor so as to operably drive the ions towards the central axis.

2. The ion guide of claim 1 wherein each of the features is upstanding from and proud of the substrate.

3. The ion guide of claim 1 wherein at least some of the features have grooves formed in an upper surface thereof.

4. The ion guide of claim 3 wherein each of the features has grooves, the grooves being configured to form a closed pupil on the bringing together of opposing substrates.

5. The ion guide of claim 1 wherein the closed pupil formed in a first diaphragm electrode is co-linear with a closed pupil in a second adjacent diaphragm electrode.

6. The ion guide of claim 1 wherein the closed pupil formed in a first diaphragm electrode is offset from a closed pupil in a second adjacent diaphragm electrode.

7. The ion guide of claim 1, in which alternate electrodes are connected together in two sets by two additional features forming two bus bars.

8. The ion guide of claim 1 being configured to effect a transportation of ions.

9. The ion guide of claim 1 being configured to effect a concentration of ions.

10. The ion guide of claim 1 being configured to effect a fragmentation of ions.

11. The ion guide of claim 1 being configured to be operable with a mass filter.

12. The ion guide of claim 11 wherein the mass filter includes a quadrupole.

13. The ion guide of claim 1 being configured to be operable in a vacuum interface.

14. The ion guide of claim 1 being configured to be operable in a collision cell.

15. The ion guide of claim 1 being configured such that alternate electrodes are connectable to different AC voltages.

16. The ion guide of claim 1 being configured such that alternate electrodes are connectable to different DC voltages.

17. The ion guide of claim 1 being configured such that the electrodes are independently driven.

18. The ion guide of claim 1 wherein the closed pupils are substantially identical.

19. The ion guide of claim 1 in which the width of each of the closed pupils varies from electrode to electrode.

20. The ion guide of claim 1 being operable as an ion funnel.

21. The ion guide of claim 1 being configured to form an ion storage ring.

22. The ion guide of claim 1 wherein the closed pupil widths are defined by lithography.

23. The ion guide of claim 1 wherein the closed pupils are formed by an etching process.

24. The ion guide of claim 1 wherein the closed pupils are formed by powder blasting.

25. The ion guide of claim 1 wherein the features are defined by lithography and etching.

26. The ion guide of claim 1 wherein the features are formed in a metal, semiconductor, a metallised semiconductor.

27. The ion guide of claim 26, in which the semiconductor is silicon.

28. The ion guide of claim 1 in which the substrates are formed in an insulator.

29. The ion guide of claim 28, in which the insulator is a glass, a plastic or a ceramic.

30. The ion guide of claim 1 including a unique identifier.

31. A mass analysis device including a mass filter and an ion guide as claimed in claim 1.

32. The device of claim 31 wherein the mass filter includes a quadrupole.

33. The device of claim 31 wherein the ion guide and mass filter are fabricated on a common substrate.

34. The device of claim 33 wherein the ion guide and mass filter are aligned such that ions emitted from the ion guide may travel into the mass filter.

35. The device of claim 31 wherein the mass filter is fabricated in two halves that are assembled by stacking.

36. The device of claim 35 wherein the stacking of the two halves provides pairs of etched, metallised features that provide mechanical mounts for and electrical connections to a plurality of rods.

37. The device of claim 36 wherein the massfilter is fabricated by stacking each of the halves and subsequently inserting rods onto the mechanical mounts, the rods on insertion straddling an etched, metallised trench formed in a raised feature.

38. A set of RF-only ion guides, each of the set of ion guides comprising first and second substrates, each of the first and second substrates having at least first and second features defined thereon, the features being configured such that when the first and second substrates are brought together the features on opposing substrates combine to form complete diaphragm electrodes containing closed pupils, the set being arranged as a parallel array; each of the closed pupils in adjacent diaphragm electrodes cooperating to form an ion path through the ion guide with a central axis of the pupils defining the ion path, and wherein neighboring electrodes are coupled to a voltage supply of an opposing polarity to that of their neighbor so as to operably drive the ions towards the central axis.

39. A method of forming a stacked ring electrode assembly capable of acting as a RF-only ion guides in an ion optical system, the method including:

processing sets of grooved, proud features in a layer of material lying on an insulating substrate, bringing together in a stack arrangement two such substrates to form a set of diaphragm electrodes with closed pupils, each of the closed pupils in adjacent diaphragm electrodes cooperating to form an ion path through the ion guide with a central axis of the pupils defining the ion path, and coupling neighboring electrodes to a voltage supply of an opposing polarity to that of their neighbor so as to operably drive the ions towards the central axis.

40. A microengineered ion guide, fabricated from first and substrates, each of the first and second substrates having compatible structures such that when the first and second substrates are brought together to form a sandwich structure the compatible structures mate with one another to form a set of electrode rings defining closed pupils, each of the closed pupils in adjacent electrode rings cooperating to form an ion path through the ion guide with a central axis of the pupils defining the ion path, and wherein neighboring electrode rings are coupled to a RF-only voltage supply of an opposing polarity to that of their neighbor so as to operably drive the ions towards the central axis.

41. The ion guide of claim 40 wherein each of the electrodes forming the set of electrode rings include an aperture defined therein, such that the ion guide includes a plurality of apertures.

42. The ion guide of claim 41 wherein the plurality of apertures are aligned with one another.

43. The ion guide of claim 41 wherein at least some of the structures have grooves formed in an upper surface thereof.

44. The ion guide of claim 40 wherein the plurality of apertures form a set of closed pupils.

45. The ion guide of claim 40 wherein the compatible structures are upstanding from and proud of their respective substrates.

* * * * *